US009204667B2

(12) United States Patent
Cantrell et al.

(10) Patent No.: US 9,204,667 B2
(45) Date of Patent: Dec. 8, 2015

(54) SMOKELESS TOBACCO PASTILLE AND INJECTION MOLDING PROCESS FOR FORMING SMOKELESS TOBACCO PRODUCTS

(75) Inventors: Daniel Verdin Cantrell, Lewisville, NC (US); Robert Frank Boutin, Hinsdale, IL (US); Thomas Hinkemeyer, Gages Lake, IL (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 1335 days.

(21) Appl. No.: 12/957,838

(22) Filed: Dec. 1, 2010

(65) Prior Publication Data

US 2012/0138073 A1 Jun. 7, 2012

(51) Int. Cl.

| | |
|---|---|
| ***A24B 1/10*** | (2006.01) |
| ***A24B 15/30*** | (2006.01) |
| ***A24B 13/00*** | (2006.01) |

(52) U.S. Cl.

CPC ..... *A24B 15/30* (2013.01); *A24B 13/00* (2013.01)

(58) Field of Classification Search

CPC ..... A24B 15/30; A24B 13/00
USPC ..... 131/352, 111
See application file for complete search history.

(56) References Cited

U.S. PATENT DOCUMENTS

| | | | | |
|---|---|---|---|---|
| 1,376,586 | A | | 5/1921 | Schwartz |
| 3,696,917 | A | | 10/1972 | Levi |
| 4,144,895 | A | | 3/1979 | Fiore |
| 4,148,325 | A | | 4/1979 | Solomon et al. |
| 4,150,677 | A | | 4/1979 | Osborne, Jr. et al. |
| 4,267,847 | A | | 5/1981 | Reid |
| 4,289,147 | A | | 9/1981 | Wildman et al. |
| 4,351,346 | A | | 9/1982 | Brummer et al. |
| 4,359,059 | A | | 11/1982 | Brummer et al. |
| 4,506,682 | A | | 3/1985 | Muller |
| 4,513,756 | A | | 4/1985 | Pittman et al. |
| 4,528,993 | A | | 7/1985 | Sensabaugh, Jr. et al. |
| 4,589,428 | A | | 5/1986 | Keritsis |
| 4,605,016 | A | | 8/1986 | Soga et al. |
| 4,624,269 | A | | 11/1986 | Story et al. |
| 4,660,577 | A | | 4/1987 | Sensabaugh et al. |
| 4,716,911 | A | | 1/1988 | Poulose et al. |
| 4,727,889 | A | | 3/1988 | Niven, Jr. et al. |
| 4,887,618 | A | | 12/1989 | Bernasek et al. |
| 4,936,920 | A | * | 6/1990 | Keritsis et al. ..... 131/77 |
| 4,941,484 | A | | 7/1990 | Clapp et al. |
| 4,967,771 | A | | 11/1990 | Fagg et al. |
| 4,986,286 | A | | 1/1991 | Roberts et al. |
| 4,987,907 | A | | 1/1991 | Townend |
| 4,991,599 | A | | 2/1991 | Tibbetts |
| 5,005,593 | A | | 4/1991 | Fagg |
| 5,018,540 | A | | 5/1991 | Grubbs et al. |
| 5,060,669 | A | | 10/1991 | White et al. |
| 5,065,775 | A | | 11/1991 | Fagg |
| 5,074,319 | A | | 12/1991 | White et al. |
| 5,092,352 | A | | 3/1992 | Sprinkle, III et al. |
| 5,099,682 | A | | 3/1992 | White et al. |
| 5,121,757 | A | | 6/1992 | White et al. |
| 5,131,414 | A | | 7/1992 | Fagg et al. |
| 5,131,415 | A | | 7/1992 | Munoz et al. |
| 5,148,819 | A | | 9/1992 | Fagg |
| 5,197,494 | A | | 3/1993 | Kramer |
| 5,230,354 | A | | 7/1993 | Smith et al. |
| 5,234,008 | A | | 8/1993 | Fagg |
| 5,243,999 | A | | 9/1993 | Smith |
| 5,301,694 | A | | 4/1994 | Raymond et al. |
| 5,318,050 | A | | 6/1994 | Gonzalez-Parra et al. |
| 5,343,879 | A | | 9/1994 | Teague |
| 5,360,022 | A | | 11/1994 | Newton et al. |
| 5,387,416 | A | | 2/1995 | White et al. |

(Continued)

FOREIGN PATENT DOCUMENTS

| | | |
|---|---|---|
| WO | WO 03/026655 | 4/2003 |
| WO | WO 2004/095959 | 11/2004 |

(Continued)

OTHER PUBLICATIONS

De Roton et al. "Factors Influencing the Formation of Tobacco-Specific Nitrosamines in French Air-Cured Tobacco in Trials and at the Farm Level", Beitrage zur Tabakforschung International/Contributions to Tobacco Research, Jul. 2005, pp. 305-320, vol. 21 No. 6.

(Continued)

*Primary Examiner* — Richard Crispino
*Assistant Examiner* — Dionne W Mayes
(74) *Attorney, Agent, or Firm* — Womble Carlyl Sandridge & Rice, LLP

(57) ABSTRACT

A smokeless tobacco composition configured for insertion into the mouth of a user is provided. The smokeless tobacco composition includes a tobacco material and a polysaccharide filler component such as polydextrose. A process for preparing a smokeless tobacco composition pastille configured for insertion into the mouth of a user is also provided. The process includes mixing a tobacco material with a binder and a polysaccharide filler component to form a smokeless tobacco mixture, injection molding the smokeless tobacco mixture, and cooling the smokeless tobacco mixture to form a solidified smokeless tobacco composition pastille. The mixing step can include forming a dry blend of the tobacco, filler, and binder components, and combining the dry blend with a viscous liquid component. The injection-molded pastille can provide a dissolvable and lightly chewable product.

28 Claims, No Drawings

(56) References Cited

U.S. PATENT DOCUMENTS

| | | | | |
|---|---|---|---|---|
| 5,435,325 | A | 7/1995 | Clapp et al. | |
| 5,445,169 | A | 8/1995 | Brinkley et al. | |
| 5,539,093 | A | 7/1996 | Fitzmaurice et al. | |
| 5,601,863 | A | 2/1997 | Borden et al. | |
| 5,668,295 | A | 9/1997 | Wahab et al. | |
| 5,705,624 | A | 1/1998 | Fitzmaurice et al. | |
| 5,844,119 | A | 12/1998 | Weigel | |
| 6,131,584 | A | 10/2000 | Lauterbach | |
| 6,284,875 | B1 | 9/2001 | Trpen et al. | |
| 6,298,859 | B1 | 10/2001 | Klerulff et al. | |
| 6,510,855 | B1 | 1/2003 | Korte et al. | |
| 6,668,839 | B2 | 12/2003 | Williams | |
| 6,730,832 | B1 | 5/2004 | Dominguez et al. | |
| 6,772,767 | B2 | 8/2004 | Mua et al. | |
| 6,817,970 | B2 | 11/2004 | Berit et al. | |
| 6,834,654 | B2 | 12/2004 | Williams | |
| 6,895,974 | B2 | 5/2005 | Peele | |
| 6,906,172 | B2 | 6/2005 | Bratcher et al. | |
| 6,953,040 | B2 | 10/2005 | Atchley et al. | |
| 7,014,039 | B2 | 3/2006 | Henson et al. | |
| 7,025,066 | B2 | 4/2006 | Lawson et al. | |
| 7,032,601 | B2 | 4/2006 | Atchley et al. | |
| 7,034,128 | B2 | 4/2006 | Turpen et al. | |
| 7,048,211 | B2 | 5/2006 | Bratcher et al. | |
| 7,173,170 | B2 | 2/2007 | Liu et al. | |
| 7,208,659 | B2 | 4/2007 | Colliver et al. | |
| 7,230,160 | B2 | 6/2007 | Benning et al. | |
| 7,337,782 | B2 | 3/2008 | Thompson | |
| D592,956 | S | 5/2009 | Thiellier | |
| 7,537,110 | B2 | 5/2009 | Kutsch et al. | |
| D594,154 | S | 6/2009 | Patel et al. | |
| 7,584,843 | B2 | 9/2009 | Kutsch et al. | |
| 7,650,892 | B1 | 1/2010 | Groves et al. | |
| 7,694,686 | B2 | 4/2010 | Atchley et al. | |
| 2004/0020503 | A1 | 2/2004 | Williams | |
| 2005/0115580 | A1 | 6/2005 | Quinter et al. | |
| 2005/0244521 | A1 | 11/2005 | Strickland et al. | |
| 2006/0037623 | A1 | 2/2006 | Lawrence, Jr. | |
| 2006/0191548 | A1* | 8/2006 | Strickland et al. | 131/347 |
| 2006/0236434 | A1 | 10/2006 | Conkling et al. | |
| 2007/0062549 | A1 | 3/2007 | Horton, Jr. et al. | |
| 2007/0144544 | A1* | 6/2007 | Cai et al. | 131/271 |
| 2007/0186941 | A1 | 8/2007 | Holton, Jr. et al. | |
| 2007/0186942 | A1 | 8/2007 | Strickland et al. | |
| 2007/0243257 | A1 | 10/2007 | Bedos et al. | |
| 2008/0029110 | A1 | 2/2008 | Dube et al. | |
| 2008/0029116 | A1 | 2/2008 | Robinson et al. | |
| 2008/0029117 | A1 | 2/2008 | Mua et al. | |
| 2008/0173317 | A1 | 7/2008 | Robinson et al. | |
| 2008/0196730 | A1 | 8/2008 | Engstrom et al. | |
| 2008/0209586 | A1 | 8/2008 | Neilsen et al. | |
| 2008/0245377 | A1 | 10/2008 | Marsahall et al. | |
| 2008/0305216 | A1 | 12/2008 | Crawford et al. | |
| 2009/0014343 | A1 | 1/2009 | Clark et al. | |
| 2009/0014450 | A1 | 1/2009 | Bjorkholm | |
| 2009/0025738 | A1 | 1/2009 | Mua et al. | |
| 2009/0025739 | A1 | 1/2009 | Brinkley et al. | |
| 2009/0065013 | A1 | 3/2009 | Essen et al. | |
| 2009/0223989 | A1 | 9/2009 | Gelardi | |
| 2009/0230003 | A1 | 9/2009 | Thiellier | |
| 2009/0250360 | A1 | 10/2009 | Bellamah et al. | |
| 2009/0266837 | A1 | 10/2009 | Gelardi et al. | |
| 2009/0293889 | A1 | 12/2009 | Kumar et al. | |
| 2010/0084424 | A1 | 4/2010 | Gelardi | |
| 2010/0133140 | A1 | 6/2010 | Bailey | |
| 2010/0275936 | A1 | 11/2010 | Bivehed | |
| 2010/0291245 | A1 | 11/2010 | Gao et al. | |
| 2010/0300464 | A1 | 12/2010 | Gee et al. | |
| 2010/0303969 | A1 | 12/2010 | Sengupta et al. | |

FOREIGN PATENT DOCUMENTS

| | | | |
|---|---|---|---|
| WO | WO 2005046363 | | 5/2005 |
| WO | WO 2007/012980 | | 2/2007 |
| WO | WO 2008/103935 | A2 | 8/2008 |
| WO | WO 2010/132444 | A2 | 11/2010 |

OTHER PUBLICATIONS

Danebower, et al. "Tobacco as a Biochemical Resource: Past, Present, and Future" Biologically Active Natural Products: Agrochemicals, pp. 155-168.

Nestor, et al. "Role of Oxides of Nitrogen in Tobacco-Specific Nitrosamine Formation in Flue-Cured Tobacco", Beitrage zur Tabakforschung International/Contributions to Tobacco Research, Nov. 2003, pp. 467-475, vol. 20 No. 7.

Staaf et al. "Formation of Tobacco-Specific Nitrosamines (TSNA) During Air-Curing: Conditions and Control", Beitrage zur Tabakforschung International/Contributions to Tobacco Research Jul. 2005, pp. 321-330, vol. 21 No. 6.

* cited by examiner

SMOKELESS TOBACCO PASTILLE AND INJECTION MOLDING PROCESS FOR FORMING SMOKELESS TOBACCO PRODUCTS

FIELD OF THE DISCLOSURE

The present disclosure relates to products made or derived from tobacco, or that otherwise incorporate tobacco, and are intended for human consumption. In particular, the disclosure relates to compositions or formulations incorporating tobacco, and that are intended to be employed in a smokeless form.

BACKGROUND OF THE DISCLOSURE

Cigarettes, cigars, and pipes are popular smoking articles that employ tobacco in various forms. Such smoking articles are employed by heating or burning tobacco to generate aerosol (e.g., smoke) that may be inhaled by the smoker. Tobacco may also be enjoyed in a so-called "smokeless" form. Particularly popular smokeless tobacco products are employed by inserting some form of processed tobacco or tobacco-containing formulation into the mouth of the user. See for example, the types of smokeless tobacco formulations, ingredients, and processing methodologies set forth in U.S. Pat. No. 1,376,586 to Schwartz; U.S. Pat. No. 3,696,917 to Levi; U.S. Pat. No. 4,513,756 to Pittman et al.; U.S. Pat. No. 4,528,993 to Sensabaugh, Jr. et al.; U.S. Pat. No. 4,624,269 to Story et al.; U.S. Pat. No. 4,991,599 to Tibbetts; U.S. Pat. No. 4,987,907 to Townsend; U.S. Pat. No. 5,092,352 to Sprinkle, III et al.; U.S. Pat. No. 5,387,416 to White et al.; U.S. Pat. No. 6,668,839 to Williams; U.S. Pat. No. 6,834,654 to Williams; U.S. Pat. No. 6,953,040 to Atchley et al.; U.S. Pat. No. 7,032,601 to Atchley et al.; and U.S. Pat. No. 7,694,686 to Atchley et al.; U.S. Pat. Pub. Nos. 2004/0020503 to Williams; 2005/0115580 to Quinter et al.; 2005/0244521 to Strickland et al.; 2006/0191548 to Strickland et al.; 2007/0062549 to Holton, Jr. et al.; 2007/0186941 to Holton, Jr. et al.; 2007/0186942 to Strickland et al.; 2008/0029110 to Dube et al.; 2008/0029116 to Robinson et al.; 2008/0029117 to Mua et al.; 2008/0173317 to Robinson et al.; 2008/0196730 to Engstrom et al.; 2008/0209586 to Neilsen et al.; 2008/0305216 to Crawford et al.; 2009/0065013 to Essen et al.; 2009/0293889 to Kumar et al.; and 2010/0291245 to Gao et al.; PCT WO 04/095959 to Arnarp et al.; and WO 2010/132444 A2 to Atchley; and U.S. patent application Ser. No. 12/638,394, filed Dec. 15, 2009, to Mua et al.; each of which is incorporated herein by reference. Exemplary smokeless tobacco products that have been marketed include those referred to as CAMEL Snus, CAMEL Orbs, CAMEL Strips and CAMEL Sticks by R. J. Reynolds Tobacco Company; GRIZZLY moist tobacco, KODIAK moist tobacco, LEVI GARRETT loose tobacco and TAYLOR'S PRIDE loose tobacco by American Snuff Company, LLC; KAYAK moist snuff and CHATTANOOGA CHEW chewing tobacco by Swisher International, Inc.; REDMAN chewing tobacco by Pinkerton Tobacco Co. LP; COPENHAGEN moist tobacco, COPENHAGEN Pouches, SKOAL Bandits, SKOAL Pouches, RED SEAL long cut and REVEL Mint Tobacco Packs by U.S. Smokeless Tobacco Company; and MARLBORO Snus and Taboka by Philip Morris USA.

It would be desirable to provide an enjoyable form of a tobacco product, such as a smokeless tobacco product, and to provide processes for preparing tobacco-containing compositions suitable for use in smokeless tobacco products.

SUMMARY OF THE DISCLOSURE

The present disclosure relates to a dissolvable smokeless tobacco pastille product configured for insertion into the mouth of a user and processes for preparing a smokeless tobacco composition suitable for use in a smokeless tobacco product. The smokeless tobacco composition of the disclosure utilizes a polysaccharide filler component to provide a dissolvable smokeless tobacco product having a lightly chewable quality in the form of an injection-molded pastille. In one embodiment, the smokeless tobacco product is in the form of a solid object having a tobacco material (e.g., particulate tobacco material) and a polysaccharide filler component. The smokeless tobacco composition preferably includes a polysaccharide filler component and tobacco in granular or particulate form, or in the form of a liquid or dehydrated tobacco extract, and may include other ingredients, such as sweeteners, binders, emulsifiers, additional fillers, flavoring agents, and disintegration aids. According to one aspect, the tobacco material includes tobacco particles having an average particle size of less than about 100 microns, less than about 75 microns, typically less than about 50 microns, and most often an average particle size of about 25 microns.

In one aspect, the disclosure provides a smokeless tobacco pastille product configured for insertion into the mouth of a user of the product, the smokeless tobacco pastille product comprising a tobacco material and a polysaccharide filler component. Suitable polysaccharide filler components for providing a smokeless tobacco pastille product in accordance with the present disclosure include polydextrose, maltodextrin, pullulan, and mixtures thereof.

The smokeless tobacco composition can further include one or more additives, such as flavorants, additional fillers, binders, emulsifiers, humectants, syrups, disintegration aids, and mixtures thereof. Certain embodiments of the smokeless tobacco product of the invention include binders (e.g., gum arabic or other water soluble gums), humectants (e.g., corn syrup), sugar alcohols (e.g., sorbitol), artificial sweeteners (e.g., sucralose), flavorants, salts (e.g., sodium chloride), or combinations thereof.

Although relative amounts of the various components can vary, the smokeless tobacco compositions of the invention will typically comprise about 10 weight percent to about 25 weight percent of the polysaccharide filler component on a dry weight basis. In one embodiment, the smokeless tobacco composition includes at least about 20 dry weight percent of tobacco material, based on the total weight of the composition; at least about 10 dry weight percent of polysaccharide filler component; at least about 10 dry weight percent of at least one binder; at least about 20 dry weight percent of at least one humectant; at least about 1 dry weight percent of at least one emulsifier; at least about 0.1 dry weight percent of at least one sweetener; and at least about 0.5 dry weight percent of at least one flavorant.

In yet another aspect, the disclosure provides a process for preparing a smokeless tobacco composition pastille configured for insertion into the mouth of a user, comprising mixing a tobacco material (e.g., particulate tobacco material) with a binder and a polysaccharide filler component to form a smokeless tobacco mixture; injection molding the smokeless tobacco mixture (e.g., by compressing the smokeless tobacco mixture using a compressive force of at least about 75,000 kPa or at least about 100,000 kPa); and cooling the smokeless tobacco mixture to form a solidified smokeless tobacco composition pastille (e.g., cooling to a temperature of about 20° C. to about 25° C.).

In one embodiment, the mixing step comprises forming a dry blend comprising a mixture of the tobacco material, the binder, and the polysaccharide filler component, and combining the dry blend with a liquid component to form the smokeless tobacco mixture. It is advantageous for all components of the dry blend to have a relatively low moisture content (e.g., less than about 5 weight percent moisture) and to have a relatively uniform particle size (e.g., less than about 50 microns). If desired, the dry blend can further comprise a salt, a sweetener, or a combination thereof. The liquid component is typically a highly viscous liquid at either room temperature or when heated to an elevated temperature (e.g., about 40° C. to about 150° C.), and will typically contain one or more humectants, emulsifiers, gelling agents, syrups, or combinations thereof.

In certain embodiments, the process can include adding an additive to the tobacco material prior to the mixing step. Exemplary additives include flavorants, emulsifiers, disintegration aids, humectants, and mixtures thereof.

In certain embodiments, prior to the injection molding process, the smokeless tobacco mixture is extruded into an extruded form, and then subjected to grinding in order to produce a powder granulation. The extruded, ground composition can be loaded into the injection mold for subsequent molding into final product form.

Aspects of the present disclosure thus provide advantages as otherwise detailed herein.

DETAILED DESCRIPTION

The present disclosure now will be described more fully hereinafter. The disclosure may be embodied in many different forms and should not be construed as limited to the aspects set forth herein; rather, these aspects are provided so that this disclosure will satisfy applicable legal requirements. As used in this specification and the claims, the singular forms "a," "an," and "the" include plural referents unless the context clearly dictates otherwise.

The invention provides a smokeless tobacco composition suitable for oral use. The smokeless tobacco composition generally includes a tobacco material formulation and one or more additional components that combine to form a dissolvable and lightly chewable smokeless tobacco pastille product. As used herein, the term "pastille" refers to a dissolvable oral product made by solidifying a liquid or gel composition, such as a composition that includes a gelling or binding agent, so that the final product is a hardened solid gel. As used herein, the terms "dissolve," "dissolving," and "dissolvable" refer to compositions having aqueous-soluble components that interact with moisture in the oral cavity and enter into solution, thereby causing gradual consumption of the product. In certain embodiments, the products of the invention are characterized by sufficient cohesiveness to withstand light chewing action in the oral cavity without rapidly disintegrating. The products of the invention typically do not exhibit a highly deformable chewing quality as found in conventional chewing gum.

In certain embodiments, advantageous organoleptic properties of the products of the invention can be attributed to the presence of a polysaccharide filler component. These carbohydrate materials typically comprise one or more polysaccharides containing multiple monosaccharide units. Exemplary monosaccharide units include xylose, ribose, fructose, glucose (e.g., dextrose), maltose, and mannose. The number average molecular weight of the polysaccharide can vary, but is typically about 1,000 Da to about 20,000 Da, more often about 2,000 Da to about 10,000 Da. Exemplary polysaccharides include polydextrose, maltodextrin, and pullulan. One source of maltodextrin is MALTRIN M100 from Grain Processing Corporation.

Polydextrose is primarily composed of a polymer comprising dextrose units with minor amounts of a polyol (e.g., sorbitol) and an edible acid (e.g., citric acid). Polydextrose is typically made by acid-catalyzed polymerization of dextrose units using, if desired, a polyol as a chain terminating agent. Exemplary edible acids include various mineral acids and carboxylic acids. Polydextrose can be made using, for example, the process set forth in U.S. Pat. No. 5,601,863 to Borden et al., which is incorporated by reference herein. Polydextrose can be described as a soluble fiber bulking agent, and polydextrose may also exhibit humectant-like properties. Exemplary sources of polydextrose include LITESSE polydextrose (available from Danisco A/S), STA-LITE polydextrose (available from Tate & Lyle Ingredients Americas, Inc.), and TRIMCAL polydextrose (available from C and H Ingredients Ltd). In one embodiment, the polydextrose is combined with a second polysaccharide component such as maltodextrin or pullulan.

The polysaccharide filler component used for the manufacture of the smokeless tobacco product preferably is provided in a ground, granulated, fine particulate, or powder form. Preferably, the polysaccharide filler component is employed in the form of parts or pieces that have an average particle size less than about 100 microns, and more preferably less than about 50 microns.

The relative amount of polysaccharide filler component within the smokeless tobacco composition may vary. Preferably, the amount of polysaccharide filler component within the smokeless tobacco composition is at least about 5 percent or at least about 10 percent or at least about 15 percent, on a dry weight basis of the composition. An exemplary weight range is about 5 to about 50 weight percent, more often about 10 to about 25 weight percent.

The moisture content of the polysaccharide filler component prior to mixing with the tobacco material formulation may vary. Most preferably, the moisture content of the polysaccharide filler component is less than about 10 weight percent, and may be less than about 5 percent, and is often less than about 2.5 weight percent.

The products of the invention incorporate some form of a plant of the *Nicotiana* species, and most preferably, those compositions or products incorporate some form of tobacco. The selection of the *Nicotiana* species can vary; and in particular, the selection of the types of tobacco or tobaccos may vary. Tobaccos that can be employed include flue-cured or Virginia (e.g., K326), burley, sun-cured (e.g., Indian Kurnool and Oriental tobaccos, including Katerini, Prelip, Komotini, Xanthi and Yambol tobaccos), Maryland, dark, dark-fired, dark air cured (e.g., Passanda, Cubano, Jatin and Bezuki tobaccos), light air cured (e.g., North Wisconsin and Galpao tobaccos), Indian air cured, Red Russian and *Rustica* tobaccos, as well as various other rare or specialty tobaccos. Descriptions of various types of tobaccos, growing practices and harvesting practices are set forth in *Tobacco Production, Chemistry and Technology*, Davis et al. (Eds.) (1999), which is incorporated herein by reference. Various representative other types of plants from the *Nicotiana* species are set forth in Goodspeed, *The Genus Nicotiana*, (Chonica Botanica) (1954); U.S. Pat. No. 4,660,577 to Sensabaugh, Jr. et al.; U.S. Pat. No. 5,387,416 to White et al. and U.S. Pat. No. 7,025,066 to Lawson et al.; U.S. Patent Appl. Pub. Nos. 2006/0037623 to Lawrence, Jr. and 2008/0245377 to Marshall et al.; each of which is incorporated herein by reference. Exemplary *Nicotiana* species include *N. tabacum, N. rustica, N. alata, N. arentsii, N. excelsior, N. forgetiana, N. glauca, N. glutinosa, N. gossei, N. kawakamii, N. knightiana, N. langsdorffi, N. otophora, N. setchelli, N. sylvestris, N. tomentosa, N. tomentosiformis, N. undulata, N. x sanderae, N. africana, N. amplexicaulis, N. benavidesii, N. bonariensis, N. debneyi, N.*

*longiflora, N. maritina, N. megalosiphon, N. occidentalis, N. paniculata, N. plumbaginifolia, N. raimondii, N. rosulata, N. simulans, N. stocktonii, N. suaveolens, N. umbratica, N. velutina, N. wigandioides, N. acaulis, N. acuminata, N. attenuata, N. benthamiana, N. cavicola, N. clevelandii, N. cordifolia, N. corymbosa, N. fragrans, N. goodspeedii, N. linearis, N. miersii, N. nudicaulis, N. obtusifolia, N. occidentalis subsp. Hersperis, N. pauciflora, N. petunioides, N. quadrivalvis, N. repanda, N. rotundifolia, N. solanifolia,* and *N. spegazzinii.*

*Nicotiana* species can be derived using genetic-modification or crossbreeding techniques (e.g., tobacco plants can be genetically engineered or crossbred to increase or decrease production of components, characteristics or attributes). See, for example, the types of genetic modifications of plants set forth in U.S. Pat. No. 5,539,093 to Fitzmaurice et al.; U.S. Pat. No. 5,668,295 to Wahab et al.; U.S. Pat. No. 5,705,624 to Fitzmaurice et al.; U.S. Pat. No. 5,844,119 to Weigl; U.S. Pat. No. 6,730,832 to Dominguez et al.; U.S. Pat. No. 7,173,170 to Liu et al.; U.S. Pat. No. 7,208,659 to Colliver et al. and U.S. Pat. No. 7,230,160 to Benning et al.; U.S. Patent Appl. Pub. No. 2006/0236434 to Conkling et al.; and PCT WO 2008/103935 to Nielsen et al.

For the preparation of smokeless and smokable tobacco products, it is typical for a harvested plant of the *Nicotiana* species to be subjected to a curing process. Descriptions of various types of curing processes for various types of tobaccos are set forth in *Tobacco Production, Chemistry and Technology, Davis* et al. (Eds.) (1999). Exemplary techniques and conditions for curing flue-cured tobacco are set forth in Nestor et al., *Beitrage Tabakforsch. Int.,* 20, 467-475 (2003) and U.S. Pat. No. 6,895,974 to Peele, which are incorporated herein by reference. Representative techniques and conditions for air curing tobacco are set forth in U.S. Pat. No. 7,650,892 to Groves et al.; Roton et al., *Beitrage Tabakforsch. Int.,* 21, 305-320 (2005) and Staaf et al., *Beitrage Tabakforsch. Int.,* 21, 321-330 (2005), which are incorporated herein by reference. Certain types of tobaccos can be subjected to alternative types of curing processes, such as fire curing or sun curing. Preferably, harvested tobaccos that are cured are then aged. As such, tobaccos used for the preparation of tobacco compositions or products most preferably incorporate components of tobaccos that have been cured and aged. Tobacco materials used in the present invention can be subjected to additional processing prior to use, such as fermentation, bleaching, and the like.

At least a portion of the plant of the *Nicotiana* species (e.g., at least a portion of the tobacco portion) can be employed in an immature form. That is, the plant, or at least one portion of that plant, can be harvested before reaching a stage normally regarded as ripe or mature. As such, for example, tobacco can be harvested when the tobacco plant is at the point of a sprout, is commencing leaf formation, is commencing flowering, or the like.

At least a portion of the plant of the *Nicotiana* species (e.g., at least a portion of the tobacco portion) can be employed in a mature form. That is, the plant, or at least one portion of that plant, can be harvested when that plant (or plant portion) reaches a point that is traditionally viewed as being ripe, over-ripe or mature. As such, for example, through the use of tobacco harvesting techniques conventionally employed by farmers, Oriental tobacco plants can be harvested, burley tobacco plants can be harvested, or Virginia tobacco leaves can be harvested or primed by stalk position.

After harvest, the plant of the *Nicotiana* species, or portion thereof, can be used in a green form (e.g., tobacco can be used without being subjected to any curing process). For example, tobacco in green form can be frozen, subjected to irradiation, yellowed, dried, cooked (e.g., roasted, fried or boiled), or otherwise subjected to storage or treatment for later use. Such tobacco also can be subjected to aging conditions.

The tobacco material may be cased and dried, and then ground to the desired form. For example, in some instances, the tobacco material formulation may be cased with an aqueous casing containing components such as sugars (e.g., fructose, glucose, and sucrose), humectants (e.g., glycerin and propylene glycol), flavoring ingredients (e.g., cocoa and licorice), and the like. Non-aqueous casing components may be applied to the tobacco in amounts of about 1 percent to about 15 percent, based on the dry weight of the tobacco.

At least a portion of the tobacco material employed in the tobacco composition or product can have the form of an extract. Tobacco extracts can be obtained by extracting tobacco using a solvent having an aqueous character such as distilled water or tap water. As such, aqueous tobacco extracts can be provided by extracting tobacco with water, such that water insoluble pulp material is separated from the aqueous solvent and the water soluble and dispersible tobacco components dissolved and dispersed therein. The tobacco extract can be employed in a variety of forms. For example, the aqueous tobacco extract can be isolated in an essentially solvent free form, such as can be obtained as a result of the use of a spray drying or freeze drying process, or other similar types of processing steps. Alternatively, the aqueous tobacco extract can be employed in a liquid form, and as such, the content of tobacco solubles within the liquid solvent can be controlled by selection of the amount of solvent employed for extraction, concentration of the liquid tobacco extract by removal of solvent, addition of solvent to dilute the liquid tobacco extract, or the like. Exemplary techniques for extracting components of tobacco are described in U.S. Pat. No. 4,144,895 to Fiore; U.S. Pat. No. 4,150,677 to Osborne, Jr. et al.; U.S. Pat. No. 4,267,847 to Reid; U.S. Pat. No. 4,289,147 to Wildman et al.; U.S. Pat. No. 4,351,346 to Brummer et al.; U.S. Pat. No. 4,359,059 to Brummer et al.; U.S. Pat. No. 4,506,682 to Muller; U.S. Pat. No. 4,589,428 to Keritsis; U.S. Pat. No. 4,605,016 to Soga et al.; U.S. Pat. No. 4,716,911 to Poulose et al.; U.S. Pat. No. 4,727,889 to Niven, Jr. et al.; U.S. Pat. No. 4,887,618 to Bernasek et al.; U.S. Pat. No. 4,941,484 to Clapp et al.; U.S. Pat. No. 4,967,771 to Fagg et al.; U.S. Pat. No. 4,986,286 to Roberts et al.; U.S. Pat. No. 5,005,593 to Fagg et al.; U.S. Pat. No. 5,018,540 to Grubbs et al.; U.S. Pat. No. 5,060,669 to White et al.; U.S. Pat. No. 5,065,775 to Fagg; U.S. Pat. No. 5,074,319 to White et al.; U.S. Pat. No. 5,099,862 to White et al.; U.S. Pat. No. 5,121,757 to White et al.; U.S. Pat. No. 5,131,414 to Fagg; U.S. Pat. No. 5,131,415 to Munoz et al.; U.S. Pat. No. 5,148,819 to Fagg; U.S. Pat. No. 5,197,494 to Kramer; U.S. Pat. No. 5,230,354 to Smith et al.; U.S. Pat. No. 5,234,008 to Fagg; U.S. Pat. No. 5,243,999 to Smith; U.S. Pat. No. 5,301,694 to Raymond et al.; U.S. Pat. No. 5,318,050 to Gonzalez-Parra et al.; U.S. Pat. No. 5,343,879 to Teague; U.S. Pat. No. 5,360,022 to Newton; U.S. Pat. No. 5,435,325 to Clapp et al.; U.S. Pat. No. 5,445,169 to Brinkley et al.; U.S. Pat. No. 6,131,584 to Lauterbach;U.S. Pat. No. 6,284,875 to Turpen et al.; U.S. Pat. No. 6,298,859 to Kierulff et al.; U.S. Pat. No. 6,772,767 to Mua et al.; U.S. Pat. No. 6,817,970 to Berit et al.; U.S. Pat. No. 6,906,172 to Bratcher et al.; U.S. Pat. No. 7,034,128 to Turpen et al.; U.S. Pat. No. 7,048,211 to Bratcher et al.; and U.S. Pat. No. 7,337,782 to Thompson, all of which are incorporated by reference herein.

The tobacco material is typically used in a form that can be described as particulate (i.e., shredded, ground, granulated, or powder form). The manner by which the tobacco material is provided in a finely divided or powder type of form may vary.

Preferably, plant parts or pieces are comminuted, ground or pulverized into a particulate form using equipment and techniques for grinding, milling, or the like. Most preferably, the plant material is relatively dry in form during grinding or milling, using equipment such as hammer mills, cutter heads, air control mills, or the like. For example, tobacco parts or pieces may be ground or milled when the moisture content thereof is less than about 15 weight percent or less than about 5 weight percent. Most preferably, the tobacco material is employed in the form of parts or pieces that have an average particle size less than about 50 microns. In one embodiment, the average particle size of the tobacco particles may be less than or equal to about 25 microns. In some instances, the tobacco particles may be sized to pass through a screen mesh. If desired, air classification equipment may be used to ensure that small sized tobacco particles of the desired sizes, or range of sizes, may be collected. If desired, differently sized pieces of granulated tobacco may be mixed together.

The relative amount of tobacco material within the smokeless tobacco composition may vary, but tobacco material is typically the predominate ingredient. Preferably, the amount of tobacco material formulation within the smokeless tobacco composition is at least about 25 percent or at least about 30 percent, on a dry weight basis of the composition. In certain instances, the amounts of other components within the smokeless tobacco composition may exceed about 40 percent, on a dry weight basis. A typical range of tobacco material formulation within the smokeless tobacco composition is about 25 to about 60 dry weight percent, more typically about 30 to about 40 dry weight percent.

In certain embodiments, the tobacco material may not be the predominate ingredient, wherein the tobacco material may be in the form of a tobacco extract having a liquid form, spray-dried form, or dehydrated form. A typical range for this type of tobacco material within the smokeless tobacco composition is about 5 to about 40 dry weight percent, about 5 to about 25 dry weight percent, about 10 to about 30 dry weight percent, or about 20 to about 40 dry weight percent.

The moisture content of the tobacco material formulation prior to mixing with any liquid substances to form the smokeless tobacco composition may vary. Most preferably, the moisture content of the tobacco material formulation is less than about 10 weight percent, and may be less than about 5 percent, and is often less than about 2.5 weight percent. The manner by which the moisture content of the tobacco material formulation is controlled may vary. For example the tobacco material formulation may be subjected to thermal or convection heating. As a specific example, the tobacco material formulation may be oven-dried, in warmed air at temperatures of about 40° C. to about 95° C. for a length of time appropriate to attain the desired moisture content. For example, the tobacco material formulation may be dried for about 12 hours to about 24 hours at about 54° C. to about 60° C.

In some instances, prior to preparation of the tobacco material formulation, the tobacco parts or pieces may be irradiated, or those parts and pieces may be pasteurized, or otherwise subjected to controlled heat treatment. Additionally, if desired, after preparation of all or a portion of the tobacco material formulation, the component materials may be irradiated, or those component materials may be pasteurized, or otherwise subjected to controlled heat treatment. For example, a tobacco material formulation may be prepared, followed by irradiation or pasteurization, and then flavoring ingredient(s) may be applied to the formulation. Representative processes are set forth in U.S. Pat. Pub. Nos. 2009/0025738 to Mua et al. and 2009/0025739 to Brinkley et al.; and U.S. application Ser. No. 12/756,656 to Beeson et al., filed Apr. 8, 2010, which are incorporated herein by reference.

The tobacco material formulation used for the manufacture of the smokeless tobacco product also can be processed, blended, formulated, combined and mixed with other materials or ingredients (i.e., additives). See, for example, those representative components, combination of components, relative amounts of those components and ingredients relative to tobacco, and manners and methods for employing those components, set forth in U.S. Pat. Pub. Nos. 2007/0062549 to Holton, et al. and 2007/0186941 to Holton, et al., each of which is incorporated herein by reference.

The additives can be artificial, or can be obtained or derived from herbal or biological sources. Exemplary types of additives include salts (e.g., sodium chloride, potassium chloride, sodium citrate, potassium citrate, sodium acetate, potassium acetate, and the like), natural sweeteners (e.g., fructose, sucrose, glucose, maltose, vanillin, ethylvanillin glucoside, mannose, galactose, lactose, and the like), artificial sweeteners (e.g., sucralose, saccharin, aspartame, acesulfame K, neotame and the like), organic and inorganic fillers (e.g., grains, processed grains, puffed grains, maltodextrin, dextrose, calcium carbonate, calcium phosphate, corn starch, lactose, sugar alcohols such as isomalt, mannitol, xylitol, or sorbitol, finely divided cellulose, vegetable protein, and the like), binders (e.g., povidone, sodium carboxymethylcellulose and other modified cellulosic types of binders, sodium alginate, xanthan gum, starch-based binders, gum arabic, gellan gum, lecithin, and the like), gelling agents (e.g., fish gelatin), pH adjusters or buffering agents (e.g., metal hydroxides, preferably alkali metal hydroxides such as sodium hydroxide and potassium hydroxide, and other alkali metal buffers such as metal carbonates, preferably potassium carbonate or sodium carbonate, or metal bicarbonates such as sodium bicarbonate, and the like), emulsifiers, colorants (e.g., dyes and pigments, including caramel coloring, titanium dioxide, and the like), humectants (e.g., glycerin, propylene glycol, and the like), oral care additives (e.g., thyme oil, eucalyptus oil, and zinc), preservatives (e.g., potassium sorbate and the like), syrups (e.g., honey, high fructose corn syrup, and the like), disintegration or compressibility aids (e.g., microcrystalline cellulose, croscarmellose sodium, crospovidone, sodium starch glycolate, pregelatinized corn starch, and the like), flavorant and flavoring mixtures, antioxidants, and mixtures thereof. Exemplary types of additives may include those described in, for example, U.S. Pat. Pub. No. 2010/0291245 to Gao et al., previously incorporated by reference herein.

Such additives may be provided in a powder or granulated form for mixing with the tobacco material formulation, or otherwise may be provided in liquid form. Most preferably, the additive when provided in a powder or granulated form is employed in the form of parts or pieces that have an average particle size less than about 50 microns. According to some aspects, the average particle size of the additive may be about 25 microns or less. The moisture content of the additives provided in a powder or granulated form may vary. Most preferably, the moisture content of the additive provided in a powder or granulated form is less than about 10 weight percent, and may be less than about 5 percent, and is often less than about 2.5 weight percent. The additive may be admixed with the particulate tobacco material in, for example, a Hobart mixer with a paddle prior to adding any liquid additives. In the event liquid additives are provided, the resultant mixture may still have a relatively low moisture content of less than about 10 weight percent, and may be less than about 5 percent, and is often less than about 2.5 weight percent. The relative amounts of the various additive components within the smokeless tobacco product may vary.

The aforementioned types of additives can be employed together (e.g., as additive formulations) or separately (e.g., individual additive components can be added at different stages involved in the preparation of the final tobacco product). The relative amounts of the various components within the smokeless tobacco formulation may vary, and typically are selected so as to provide the desired sensory and performance characteristics to the tobacco product. Furthermore, the aforementioned types of additives may be encapsulated as provided in the final product or composition. Exemplary encapsulated additives are described, for example, in WO 2010/132444 A2 to Atchley, which has been previously incorporated by reference herein.

Any of the above-noted classes of additives for the smokeless tobacco composition of the invention can be derived from tobacco material by subjecting at least a portion of a tobacco plant (e.g., leaves, seeds, flowers, stalks, roots, or stems) to a separation process, which typically can include multiple sequential extraction steps, in order to isolate desired components of the tobacco material. Exemplary separation processes include chromatography, distillation, filtration, recrystallization, solvent-solvent partitioning, cold pressing, solvent extraction (e.g., using solvents such as water, alcohols or hydrocarbons such as heptane or hexane), or a combination thereof. The resulting isolated tobacco component can be chemically transformed prior to use in the compositions of the invention. Exemplary chemical transformations include hydrogenation, esterification, transesterification, isomeric conversion, acetal formation, acetal decomposition, acid/base reaction, hydrolysis, thermal treatment, enzymatic treatment, and combinations of such steps. Techniques for preparing tobacco isolates for use in the compositions of the invention are set forth, for example, in U.S. application Ser. No. 12/688,294 to Coleman, III et al., filed Jan. 15, 2010, and U.S. application Ser. No. 12/764,613 to Coleman, III et al., filed Apr. 21, 2010, which are incorporated by reference herein in their entirety. Examples of the types of compounds that may be present in the tobacco isolate include hydrocarbons, cellulose, alcohols, aldehydes, ketones, carboxylic acids, amino acids, esters, lactones, anhydrides, carbohydrates (e.g., reducing sugars), phenols, quinones, ethers, nitriles, amines, amides, imides, plastid pigments, proteins, coenzyme-Q, pectin, starch, lignin, and lipids. Additional examples are described as natural tar diluents in PCT WO 2007/012980 to Lipowicz, which is incorporated by reference herein in its entirety. The type or function of a smokeless tobacco additive prepared from a tobacco isolate will vary depending on the composition of the isolate, which can vary in part based on the extraction process employed, the portion of the tobacco plant involved, the type of chemical transformation utilized, and the like. Certain tobacco isolates can provide sugars, fillers, binders, disintegration or compressibility aids, or flavorants for the smokeless tobacco composition of the invention.

As used herein, a "flavorant" or "flavoring agent" is any flavorful or aromatic substance capable of altering the sensory characteristics associated with the smokeless tobacco composition. Exemplary sensory characteristics that can be modified by the flavorant include, taste, mouthfeel, moistness, coolness/heat, and/or fragrance/aroma. The flavorants can be natural or synthetic, and the character of these flavors can be described as, without limitation, fresh, sweet, herbal, confectionary, floral, fruity or spice. Specific types of flavors include, but are not limited to, vanilla, coffee, chocolate, cream, mint, spearmint, menthol, peppermint, wintergreen, lavender, cardamon, nutmeg, cinnamon, clove, cascarilla, sandalwood, honey, jasmine, ginger, anise, sage, licorice, lemon, orange, apple, peach, lime, cherry, and strawberry. Flavorants utilized in the invention also can include components that are considered moistening, cooling or smoothening agents, such as eucalyptus. These flavors may be provided neat (i.e., alone) or in a composite (e.g., spearmint and menthol or orange and cinnamon). In some instances, the flavorant may be provided in a spray-dried form. Flavorants are typically present in an amount of about 0.5 to about 10 dry weight percent, often about 1 to about 6 dry weight percent, and most often about 2 to about 5 dry weight percent.

Sweeteners can be used in natural or artificial form or as a combination of artificial and natural sweeteners. In one embodiment, sucralose is a primary sweetener ingredient. When present, a representative amount of sweetener, whether an artificial sweetener and/or natural sugar, may make up at least about 0.2 percent or at least about 5 percent, of the total dry weight of the composition. Preferably, the amount of sweetener within the composition will not exceed about 40 percent, often will not exceed about 35 percent, and frequently will not exceed about 30 percent, of the total dry weight of the composition.

A syrup preferably may be employed in amounts sufficient to provide desired flavor attributes to the smokeless tobacco composition. When present, a representative amount of syrup (e.g., high fructose corn syrup) may make up less than about 5 percent of the total dry weight of the composition.

The smokeless tobacco compositions of the disclosure may typically include at least one filler ingredient in addition to the polysaccharide filler component. Such components of the composition often fulfill multiple functions, such as enhancing certain organoleptic properties such as texture and mouthfeel, enhancing cohesiveness or compressibility of the product, and the like. When present, a representative amount of additional filler, whether an organic and/or inorganic filler, may make up at least about 10 percent, at least about 20 percent, or at least about 25 percent, based on the total dry weight of the composition. Preferably, the amount of additional filler within the composition will not exceed about 50 percent, and frequently will not exceed about 40 percent, of the total dry weight of the composition. In one embodiment, a sugar alcohol such as sorbitol is provided as an additional filler.

A salt (e.g., sodium chloride) may be employed in amounts sufficient to provide desired sensory attributes to the smokeless tobacco composition. When present, a representative amount of salt will typically make up less than about 2 percent of the total dry weight of the composition.

A humectant (e.g., glycerin) may be employed in amounts sufficient to provide desired moisture attributes to the smokeless tobacco composition. When present, a representative amount of humectant will typically make up at least about 1 percent of the total dry weight of the composition, and often at least about 2 percent by weight. In certain embodiments, the amount of humectants is at least about 10 dry weight percent or at least about 20 dry weight percent. An exemplary dry weight range is about 1 to about 40 weight percent, more often about 3 to about 35 dry weight percent.

A binder may be employed in amounts sufficient to provide the desired physical attributes and physical integrity to the smokeless tobacco composition. When present, a representative amount of binder may make up at least about 5 percent or at least about 10 percent of the total dry weight of the composition. Preferably, the amount of binder within the composition will not exceed about 35 percent of the total dry weight of the composition. Often, the amount of binder within a desirable composition will not exceed about 20 percent, and frequently will not exceed about 15 percent, of the total dry weight of the composition. Representative binders include various natural gums, which are typically water soluble to some degree, such as xanthan gum, guar gum, gum arabic, ghatti gum, gum tragacanth, karaya gum, locust bean gum, gellan gum, and combinations thereof.

An emulsifier may be employed in amounts sufficient to provide desired stabilization attributes to the smokeless tobacco composition. When present, a representative amount of emulsifier will typically make up less than about 5 percent of the total dry weight of the composition.

Representative smokeless tobacco compositions may incorporate about 25 to about 35 percent tobacco, about 10 to about 20 percent polysaccharide filler component (e.g., polydextrose), about 0 to about 1 percent artificial sweetener, about 25 to about 35 percent humectant, about 1 to about 2 percent emulsifier, about 3 to about 5 percent syrup, about 10 to about 20 percent binder, flavoring ingredient in an amount of up to about 1 percent, and salt in an amount up to about 2 percent, based on the total dry weight of the smokeless tobacco composition. The particular percentages and choice of ingredients will vary depending upon the desired flavor, texture, and other characteristics.

The manner by which the various components of the smokeless tobacco composition are combined may vary. The various components of the smokeless tobacco composition may be contacted, combined, or mixed together in conical-type blenders, mixing drums, ribbon blenders, or the like, such as a Hobart mixer. As such, the overall mixture of various components with the powdered tobacco components may be relatively uniform in nature. See also, for example, the types of methodologies set forth in U.S. Pat. No. 4,148,325 to Solomon et al.; U.S. Pat. No. 6,510,855 to Korte et al.; and U.S. Pat. No. 6,834,654 to Williams, each of which is incorporated herein by reference.

The ingredients forming the dissolvable smokeless tobacco composition are prepared such that the mixture thereof may be used in an injection molding process for forming the smokeless tobacco product. In one aspect, all dry ingredients, including the particulate tobacco material and binder, are admixed. In this regard, at least the particulate tobacco material, polysaccharide filler component, and binder may be placed in a mixing vessel (e.g., Hobart mixer—Model N-50) for mixing. After mixing the dry ingredients, a liquid mixture may be added to the dry mix. That is, in some instances, some ingredients (e.g., syrups, humectants, emulsifiers) may be heated to form a liquid melt solution. The resultant mixture of dry and liquid ingredients may then be passed through a grinder apparatus (e.g., meat grinder on the Hobart mixer—Model M802) so as to force the liquid ingredients into the dry ingredients via an extrusion process, which forms a paste-like substance. The extruded substance may then be placed into a small Hobart mixer and mixed so as to form a powder granulation.

After preparing the smokeless tobacco composition, an injection molding procedure may be used to form the smokeless tobacco pastille product. In this regard, an injection molding apparatus may be used to exert compressive forces on the smokeless tobacco composition. As used herein, the term "injection-molded" refers to a product formed by injecting or otherwise forcing a liquid, semi-liquid, or granulation composition into a mold or other forming device(s), with application of compressive force applied to the injected composition. The smokeless tobacco composition to be injection molded will typically have a moisture content of less than about 5 percent by weight, and often less than about 2.5 percent by weight. The smokeless tobacco composition is transferred to a mold, which in some instances may be a steel block in two discrete pieces. In some instances, a so-called "one-up" mold may be used, wherein a mold block comprises two halves of steel with a cored out shape. The interior formed by the mold is shaped to provide a desired configuration associated with the final pastille product. In some instances, the mold block may be heated to an elevated temperature such as, for example, to about 50° C. to about 100° C., and preferably to about 60° C. The smokeless tobacco composition is poured into the mold block and then a compressive pressure is applied to the smokeless tobacco composition using, for example, a hydraulic press unit (e.g., Wabach Hydraulic Press, Model 12-102T, Serial 2201). According to one aspect, a compressive force of at least about 75,000 kPa, and preferably at least about 100,000 kPa, is applied to the smokeless tobacco composition, although the amount of compressive force applied may vary. For example, a compressive force of at least about 30,000 kPa to about 120,000 kPa may be applied.

The amount of time the smokeless tobacco composition is compressed may vary. For example, the smokeless tobacco composition may be compressed for about 1 minute to about 5 minutes. After applying the compressive force, the smokeless tobacco composition may be removed from the injection mold after cooling the mold block to about 30° C. to about 40° C. The smokeless tobacco composition may then be allowed to cool at ambient temperature or at about 20° C. to about 25° C. The resultant pastille product may be provided in individual pieces weighing between about 4 grams to about 15 grams, although aspects of the present disclosure are not limited to such weights. It is noted, however, that exact injection molded formulations may depend upon equipment used, desired characteristics of the final product, amount of heat/pressure applied, etc.

The dissolvable smokeless tobacco pastille product can be provided in any suitable predetermined shape or form, and most preferably is provided in the form having a general shape of a pill, pellet, tablet, coin, bead, ovoid, obloid, cube, or the like. The mouthfeel of the smokeless tobacco product is preferably a slightly chewable and dissolvable quality. According to one aspect, the dissolvable smokeless tobacco pastille product is preferably capable of lasting in the user's mouth for about 10-15 minutes until it completely dissolves. Preferably, the pastille products do not, to any substantial degree, leave any residue in the mouth of the user thereof, and do not impart a slick, waxy, or slimy sensation to the mouth of the user.

According to some aspects, the tobacco particulate component of the pastille composition may be replaced with other suitable botanical particulate components such as, for example, tea particulates, coffee particulates, herbal particulates, spice particulates and/or combinations thereof. The particulates may be typically provided in a powder form, which may be extracted from an appropriate botanical source.

Products of the present invention may be packaged and stored in any suitable packaging. See, for example, the various types of containers for smokeless types of products that are set forth in U.S. Pat. No. 7,014,039 to Henson et al.; U.S. Pat. No. 7,537,110 to Kutsch et al.; U.S. Pat. No. 7,584,843 to Kutsch et al.; U.S. Pat. No. D592,956 to Thiellier and U.S. Pat. No. D594,154 to Patel et al.; U.S. Pat. Pub. Nos. 2008/0173317 to Robinson et al.; 2009/0014343 to Clark et al.; 2009/0014450 to Bjorkholm; 2009/0250360 to Bellamah et al.; 2009/0266837 to Gelardi et al.; 2009/0223989 to Gelardi; 2009/0230003 to Thiellier; 2010/0084424 to Gelardi; and 2010/0133140 to Bailey et al; and U.S. patent application Ser. Nos. 29/342,212, filed Aug. 20, 2009, to Bailey et al.; Ser. No. 12/425,180, filed Apr. 16, 2009, to Bailey et al.; Ser. No. 12/685,819, filed Jan. 12, 2010, to Bailey et al.; and Ser. No. 12/814,015, filed Jun. 11, 2010, to Gelardi et al., which are incorporated herein by reference.

EXPERIMENTAL

The following examples are provided to illustrate further aspects associated with the present invention, but should not be construed as limiting the scope thereof. Unless otherwise noted, all parts and percentages are by dry weight.

Example 1

A smokeless tobacco composition suitable for use as a smokeless tobacco product for oral use is provided in the following manner.

A 70% sugar solution is prepared. The sugar solution is admixed and heated with corn syrup, glycerin, and a flavorant to form a liquid blend.

A tobacco material having an average particle size of less than about 100 microns is mixed with a salt, sucralose, and a binder material (gum arabic) in a Hobart mixing bowl. The liquid blend is added to the Hobart mixing bowl containing the tobacco and binder material, wherein the ingredients are admixed in a Hobart mixer (Model N-50) for about 4-5 minutes at about 120 rpm to form a smokeless tobacco composition. The smokeless tobacco composition is extruded through a grinder apparatus. Upon extrusion, the smokeless tobacco composition is placed in a Hobart mixer to form a powder granulation. The mixture of the smokeless tobacco composition is about 28 parts binder material, 30.7 parts tobacco material, 32.7 parts sugar solution, 3.5 parts corn syrup, 2.1 parts glycerin, 1.8 parts salt, 0.2 parts sucralose, and 1 part flavorant.

The granulated smokeless tobacco composition is transferred to an injection mold and compressed at about 103,500 kPa for 1 minute. The mold is a stainless steel two-piece block that is filled with the smokeless tobacco composition and then compressed via engagement with a hydraulic press unit (Wabach Hydraulic Press, Model 12-102T, Serial 2201). The smokeless tobacco composition is removed from the injection mold after cooling at ambient temperature for about 60 minutes.

Example 2

A smokeless tobacco composition suitable for use as a smokeless tobacco product for oral use is provided in the following manner.

A 70% sugar solution is prepared. The sugar solution is admixed and heated with an emulsifier (available as DUR-EM 117 from Loders Croklaan), corn syrup, glycerin, and a flavorant to form a liquid blend.

A tobacco material having an average particle size of less than about 100 microns is mixed with salt, sucralose, and a binder material (gum arabic) in a Hobart mixing bowl. The liquid blend is added to the Hobart mixing bowl containing the tobacco and binder material, wherein the ingredients are admixed in Hobart mixer (Model N-50) for about 4-5 minutes at about 120 rpm to form a smokeless tobacco composition. The smokeless tobacco composition is extruded through a grinder apparatus. Upon extrusion, the smokeless tobacco composition is placed in a Hobart mixer to form a powder granulation. The mixture of the smokeless tobacco composition is about 28 parts binder material, 30.7 parts tobacco material, 0.5 parts emulsifier, 32.1 parts sugar solution, 3.5 parts corn syrup, 2.1 parts glycerin, 1.8 parts salt, 0.2 parts sucralose, and 1 part flavorant.

The granulated smokeless tobacco composition is transferred to an injection mold and compressed at about 103,500 kPa for 1 minute. The mold is a stainless steel two-piece block that is filled with the smokeless tobacco composition and then compressed via engagement with a hydraulic press unit (Wabach Hydraulic Press, Model 12-102T, Serial 2201). The smokeless tobacco composition is removed from the injection mold after cooling at ambient temperature for about 60 minutes.

Example 3

A smokeless tobacco composition suitable for use as a smokeless tobacco product for oral use is provided in the following manner.

A filler (sorbitol), an emulsifier (available as DUR-EM 117 from Loders Croklaan), corn syrup, glycerin and a flavorant are admixed and heated to form a liquid blend.

A tobacco material blend of two types of tobacco material having an average particle size of less than about 100 microns is mixed with salt, sucralose and a binder material (gum arabic) in a Hobart mixing bowl. The liquid blend is added to the Hobart mixing bowl containing the tobacco material blend and the binder material, wherein the ingredients are admixed in Hobart mixer (Model N-50) for about 4-5 minutes at about 120 rpm to form a smokeless tobacco composition. The smokeless tobacco composition is extruded through a grinder apparatus. Upon extrusion, the smokeless tobacco composition is placed in a Hobart mixer to form a powder granulation. The mixture of the smokeless tobacco composition is about 28 parts binder material, 30.6 parts tobacco material, 28 parts filler, 5 parts emulsifier, 3.5 parts corn syrup, 2.1 parts glycerin, 1.8 parts salt, 0.2 parts sucralose, and 0.8 parts flavorant.

The granulated smokeless tobacco composition is transferred to an injection mold and compressed at about 103,500 kPa for 1 minute. The mold is a stainless steel two-piece block that is filled with the smokeless tobacco composition and then compressed via engagement with a hydraulic press unit (Wabach Hydraulic Press, Model 12-102T, Serial 2201). The smokeless tobacco composition is removed from the injection mold after cooling at ambient temperature for about 60 minutes.

Example 4

A smokeless tobacco composition suitable for use as a smokeless tobacco product for oral use is provided in the following manner.

A filler (maltitol; available as LYCASIN from Roquette Frères S.A.), an emulsifier (available as DUR-EM 117 from Loders Croklaan), corn syrup, glycerin and a flavorant are admixed and heated to form a liquid blend.

A tobacco material blend of two types of tobacco material having an average particle size of less than about 100 microns is mixed with salt, sucralose and a binder material (gum arabic) in a Hobart mixing bowl. The liquid blend is added to the Hobart mixing bowl containing the tobacco material blend and the binder material, wherein the ingredients are admixed in Hobart mixer (Model N-50) for about 4-5 minutes at about 120 rpm to form a smokeless tobacco composition. The smokeless tobacco composition is passed through a meat grinder on the Hobart mixer to incorporate the liquid ingredients into the dry ingredients. The smokeless tobacco composition is extruded through a grinder apparatus. Upon extrusion, the smokeless tobacco composition is placed in a Hobart mixer to form a powder granulation. The mixture of the smokeless tobacco composition is about 27.2 parts binder material, 29.6 parts tobacco material, 27.2 parts filler, 7.8 parts emulsifier, 3.4 parts corn syrup, 2 parts glycerin, 1.7 parts salt, 0.2 parts sucralose, and 0.8 parts flavorant.

The granulated smokeless tobacco composition is transferred to an injection mold and compressed at about 103,500 kPa for 1 minute. The mold is a stainless steel two-piece block that is filled with the smokeless tobacco composition and then compressed via engagement with a hydraulic press unit (Wabach Hydraulic Press, Model 12-102T, Serial 2201). The smokeless tobacco composition is removed from the injection mold after cooling at ambient temperature for about 60 minutes.

Example 5

A smokeless tobacco composition suitable for use as a smokeless tobacco product for oral use is provided in the following manner.

A filler (maltitol; available as LYCASIN from Roquette Frères S.A.), an emulsifier (available as DUR-EM 117 from Loders Croklaan), corn syrup, glycerin and a flavorant are admixed and heated to form a liquid blend.

A tobacco material blend of two types of tobacco material having an average particle size of less than about 100 microns is mixed with salt, sucralose and a binder material (xanthan gum) in a Hobart mixing bowl. The liquid blend is added to the Hobart mixing bowl containing the tobacco material blend and the binder material, wherein the ingredients are admixed in Hobart mixer (Model N-50) for about 4-5 minutes at about 120 rpm to form a smokeless tobacco composition. The smokeless tobacco composition is passed through a meat grinder on the Hobart mixer to incorporate the liquid ingredients into the dry ingredients. The smokeless tobacco composition is extruded through a grinder apparatus. Upon extrusion, the smokeless tobacco composition is placed in a Hobart mixer to form a powder granulation. The mixture of the smokeless tobacco composition is about 27.2 parts binder material, 29.6 parts tobacco material, 27.2 parts filler, 7.8 parts emulsifier, 3.4 parts corn syrup, 2 parts glycerin, 1.7 parts salt, 0.2 parts sucralose, and 0.8 parts flavorant.

The granulated smokeless tobacco composition is transferred to an injection mold and compressed at about 103,500 kPa for 1 minute. The mold is a stainless steel two-piece block that is filled with the smokeless tobacco composition and then compressed via engagement with a hydraulic press unit (Wabach Hydraulic Press, Model 12-102T, Serial 2201). The smokeless tobacco composition is removed from the injection mold after cooling at ambient temperature for about 60 minutes.

Example 6

A smokeless tobacco composition suitable for use as a smokeless tobacco product for oral use is provided in the following manner.

A filler (maltitol; available as LYCASIN from Roquette Frères S.A.), an emulsifier (available as DUR-EM 117 from Loders Croklaan), corn syrup, glycerin and a flavorant are admixed and heated to form a liquid blend.

A tobacco material blend of two types of tobacco material having an average particle size of less than about 100 microns is mixed with salt, sucralose and a binder material (available as NYMCEL ZSX-W from CP Kelco) in a Hobart mixing bowl. The liquid blend is added to the Hobart mixing bowl containing the tobacco material blend and the binder material, wherein the ingredients are admixed in Hobart mixer (Model N-50) for about 4-5 minutes at about 120 rpm to form a smokeless tobacco composition. The smokeless tobacco composition is passed through a meat grinder on the Hobart mixer to incorporate the liquid ingredients into the dry ingredients. The smokeless tobacco composition is extruded through a grinder apparatus. Upon extrusion, the smokeless tobacco composition is placed in a Hobart mixer to form a powder granulation. The mixture of the smokeless tobacco composition is about 27.2 parts binder material, 29.6 parts tobacco material, 27.2 parts filler, 7.8 parts emulsifier, 3.4 parts corn syrup, 2 parts glycerin, 1.7 parts salt, 0.2 parts sucralose, and 0.8 parts flavorant.

The granulated smokeless tobacco composition is transferred to an injection mold and compressed at about 103,500 kPa for 1 minute. The mold is a stainless steel two-piece block that is filled with the smokeless tobacco composition and then compressed via engagement with a hydraulic press unit (Wabach Hydraulic Press, Model 12-102T, Serial 2201). The smokeless tobacco composition is removed from the injection mold after cooling at ambient temperature for about 60 minutes.

Example 7

A smokeless tobacco composition suitable for use as a smokeless tobacco product for oral use is provided in the following manner.

A filler (maltitol; available as LYCASIN from Roquette Frères S.A.), an emulsifier (available as DUR-EM 117 from Loders Croklaan), corn syrup, glycerin and a flavorant are admixed and heated to form a liquid blend.

A tobacco material blend of two types of tobacco material having an average particle size of less than about 100 microns is mixed with salt, sucralose and a binder material (gellan gum) in a Hobart mixing bowl. The liquid blend is added to the Hobart mixing bowl containing the tobacco material blend and the binder material, wherein the ingredients are admixed in Hobart mixer (Model N-50) for about 4-5 minutes at about 120 rpm to form a smokeless tobacco composition. The smokeless tobacco composition is passed through a meat grinder on the Hobart mixer to incorporate the liquid ingredients into the dry ingredients. The smokeless tobacco composition is extruded through a grinder apparatus. Upon extrusion, the smokeless tobacco composition is placed in a Hobart mixer to form a powder granulation. The mixture of the smokeless tobacco composition is about 27.2 parts binder material, 29.6 parts tobacco material, 27.2 parts filler, 7.8 parts emulsifier, 3.4 parts corn syrup, 2 parts glycerin, 1.7 parts salt, 0.2 parts sucralose, and 0.8 parts flavorant.

The granulated smokeless tobacco composition is transferred to an injection mold and compressed at about 103,500 kPa for 1 minute. The mold is a stainless steel two-piece block that is filled with the smokeless tobacco composition and then compressed via engagement with a hydraulic press unit (Wabach Hydraulic Press, Model 12-102T, Serial 2201). The smokeless tobacco composition is removed from the injection mold after cooling at ambient temperature for about 60 minutes.

Example 8

A smokeless tobacco composition suitable for use as a smokeless tobacco product for oral use is provided in the following manner.

A filler (maltitol; available as LYCASIN from Roquette Frères S.A.), an emulsifier (available as DUR-EM 117 from Loders Croklaan), corn syrup, glycerin and a flavorant are admixed and heated to form a liquid blend.

A tobacco material blend of two types of tobacco material having an average particle size of less than about 100 microns is mixed with salt, sucralose and a binder material (gum arabic) in a Hobart mixing bowl. The liquid blend is added to the Hobart mixing bowl containing the tobacco material blend and the binder material, wherein the ingredients are admixed in Hobart mixer (Model N-50) for about 4-5 minutes at about 120 rpm to form a smokeless tobacco composition. The smokeless tobacco composition is passed through a meat grinder on the Hobart mixer to incorporate the liquid ingredients into the dry ingredients. The smokeless tobacco composition is extruded through a grinder apparatus. Upon extrusion, the smokeless tobacco composition is placed in a Hobart mixer to form a powder granulation. The mixture of the smokeless tobacco composition is about 29.2 parts binder material, 31.8 parts tobacco material, 29.2 parts filler, 1 part emulsifier, 3.6 parts corn syrup, 2.2 parts glycerin, 1.9 parts salt, 0.2 parts sucralose, and 0.8 parts flavorant.

The granulated smokeless tobacco composition is transferred to an injection mold and compressed at about 103,500 kPa for 1 minute. The mold is a stainless steel two-piece block that is filled with the smokeless tobacco composition and then compressed via engagement with a hydraulic press unit (Wabach Hydraulic Press, Model 12-102T, Serial 2201). The smokeless tobacco composition is removed from the injection mold after cooling at ambient temperature for about 60 minutes.

Example 9

A smokeless tobacco composition suitable for use as a smokeless tobacco product for oral use is provided in the following manner.

A humectant (available as HYSTAR 3375 from Corn Products International), an emulsifier (available as DUR-EM 117 from Loders Croklaan), corn syrup, glycerin and a flavorant are admixed and heated to form a liquid blend.

A tobacco material blend of two types of tobacco material having an average particle size of less than about 100 microns is mixed with salt, sucralose, a binder material (gum arabic) and polydextrose powder (available as LITESSE from Danisco A/S) in a Hobart mixing bowl. The liquid blend is added to the Hobart mixing bowl containing the tobacco material blend, binder material, and polydextrose powder, wherein the ingredients are admixed in Hobart mixer (Model N-50) for about 4-5 minutes at about 120 rpm to form a smokeless tobacco composition. The smokeless tobacco composition is passed through a meat grinder on the Hobart mixer to incorporate the liquid ingredients into the dry ingredients. The smokeless tobacco composition is extruded through a grinder apparatus. Upon extrusion, the smokeless tobacco composition is placed in a Hobart mixer to form a powder granulation. The mixture of the smokeless tobacco composition is about 14.6 parts binder material, 31.8 parts tobacco material, 29.2 parts humectant, 1 part emulsifier, 14.6 parts polydextrose, 3.6 parts corn syrup, 2.2 parts glycerin, 1.9 parts salt, 0.2 parts sucralose, and 0.8 parts flavorant.

The granulated smokeless tobacco composition is transferred to an injection mold and compressed at about 103,500 kPa for 1 minute. The mold is a stainless steel two-piece block that is filled with the smokeless tobacco composition and then compressed via engagement with a hydraulic press unit (Wabach Hydraulic Press, Model 12-102T, Serial 2201). The smokeless tobacco composition is removed from the injection mold after cooling at ambient temperature for about 60 minutes.

Example 10

A smokeless tobacco composition suitable for use as a smokeless tobacco product for oral use is provided in the following manner.

A filler (maltitol; available as LYCASIN from Roquette Frères S.A.), an emulsifier (available as DUR-EM 117 from Loders Croklaan), corn syrup, glycerin and a flavorant are admixed and heated to form a liquid blend.

A tobacco material blend of two types of tobacco material having an average particle size of less than about 100 microns is mixed with salt, sucralose, a binder material (gum arabic) and a polysaccharide (maltodextrin; available as MALTRIN M100 from Grain Processing Corporation) in a Hobart mixing bowl. The liquid blend is added to the Hobart mixing bowl containing the tobacco material blend, binder material, and polysaccharide, wherein the ingredients are admixed in Hobart mixer (Model N-50) for about 4-5 minutes at about 120 rpm to form a smokeless tobacco composition. The smokeless tobacco composition is passed through a meat grinder on the Hobart mixer to incorporate the liquid ingredients into the dry ingredients. The smokeless tobacco composition is extruded through a grinder apparatus. Upon extrusion, the smokeless tobacco composition is placed in a Hobart mixer to form a powder granulation. The mixture of the smokeless tobacco composition is about 14.6 parts binder material, 31.8 parts tobacco material, 14.6 parts polysaccharide, 29.2 parts filler, 1 part emulsifier, 3.6 parts corn syrup, 2.2 parts glycerin, 1.9 parts salt, 0.2 parts sucralose, and 0.8 parts flavorant.

The granulated smokeless tobacco composition is transferred to an injection mold and compressed at about 103,500 kPa for 1 minute. The mold is a stainless steel two-piece block that is filled with the smokeless tobacco composition and then compressed via engagement with a hydraulic press unit (Wabach Hydraulic Press, Model 12-102T, Serial 2201). The smokeless tobacco composition is removed from the injection mold after cooling at ambient temperature for about 60 minutes.

Example 11

A smokeless tobacco composition suitable for use as a smokeless tobacco product for oral use is provided in the following manner.

A filler (maltitol; available as LYCASIN from Roquette Frères S.A.), an emulsifier (available as DUR-EM 117 from Loders Croklaan), corn syrup, glycerin and a flavorant are admixed and heated to form a liquid blend.

A tobacco material blend of two types of tobacco material having an average particle size of less than about 100 microns is mixed with salt, sucralose, a binder material (gum arabic) and a polysaccharide (pullulan powder) in a Hobart mixing bowl. The liquid blend is added to the Hobart mixing bowl containing the tobacco material blend, binder material, and polysaccharide, wherein the ingredients are admixed in Hobart mixer (Model N-50) for about 4-5 minutes at about 120 rpm to form a smokeless tobacco composition. The smokeless tobacco composition is passed through a meat grinder on the Hobart mixer to incorporate the liquid ingredients into the dry ingredients. The smokeless tobacco composition is extruded through a grinder apparatus. Upon extrusion, the smokeless tobacco composition is placed in a Hobart mixer to form a powder granulation. The mixture of the smokeless tobacco composition is about 14.6 parts binder material, 31.8 parts tobacco material, 14.6 parts polysaccharide, 29.2 parts filler, 1 part emulsifier, 3.6 parts corn syrup, 2.2 parts glycerin, 1.9 parts salt, 0.2 parts sucralose, and 0.8 parts flavorant.

The granulated smokeless tobacco composition is transferred to an injection mold and compressed at about 103,500 kPa for 1 minute. The mold is a stainless steel two-piece block that is filled with the smokeless tobacco composition and then compressed via engagement with a hydraulic press unit (Wabach Hydraulic Press, Model 12-102T, Serial 2201). The smokeless tobacco composition is removed from the injection mold after cooling at ambient temperature for about 60 minutes.

Example 12

A smokeless tobacco composition suitable for use as a smokeless tobacco product for oral use is provided in the following manner.

A humectant (available as HYSTAR 3375 from Corn Products International), an emulsifier (available as DUR-EM 117 from Loders Croklaan), corn syrup, glycerin and a flavorant are admixed and heated to form a liquid blend.

A tobacco material blend of two types of tobacco material having an average particle size of less than about 100 microns is mixed with salt, sucralose, a binder material (gum arabic) and polydextrose powder (available as LITESSE from Danisco A/S) in a Hobart mixing bowl. The liquid blend is added to the Hobart mixing bowl containing the tobacco material blend, binder material, and polydextrose powder, wherein the ingredients are admixed in Hobart mixer (Model N-50) for about 4-5 minutes at about 120 rpm to form a smokeless tobacco composition. The smokeless tobacco composition is passed through a meat grinder on the Hobart mixer to incorporate the liquid ingredients into the dry ingredients. The smokeless tobacco composition is extruded through a grinder apparatus. Upon extrusion, the smokeless tobacco composition is placed in a Hobart mixer to form a powder granulation. The mixture of the smokeless tobacco composition is about 15.1 parts binder material, 32.9 parts tobacco material, 26.9 parts humectant, 1.1 parts emulsifier, 15.1 parts polydextrose, 3.8 parts corn syrup, 2.3 parts glycerin, 1.9 parts salt, 0.2 parts sucralose, and 0.9 parts flavorant.

The granulated smokeless tobacco composition is transferred to an injection mold and compressed at about 103,500 kPa for 1 minute. The mold is a stainless steel two-piece block that is filled with the smokeless tobacco composition and then compressed via engagement with a hydraulic press unit (Wabach Hydraulic Press, Model 12-102T, Serial 2201). The smokeless tobacco composition is removed from the injection mold after cooling at ambient temperature for about 60 minutes.

Example 13

A smokeless tobacco composition suitable for use as a smokeless tobacco product for oral use is provided in the following manner.

A humectant (available as HYSTAR 3375 from Corn Products International), an emulsifier (available as DUR-EM 117 from Loders Croklaan), a vegetable protein (available from Freeman Industries LLC), corn syrup, and glycerin are admixed to form a liquid blend. The liquid blend is heated to about 54° C. A flavorant is added to the heated liquid blend.

A tobacco material blend of two types of tobacco material having an average particle size of less than about 100 microns is mixed with a binder material (gum arabic), a salt, a sweetener (sucralose) and polydextrose powder (available as LITESSE from Danisco A/S) in a Hobart mixing bowl. The liquid blend is added to the Hobart mixing bowl containing the tobacco material blend, binder material, salt, sweetener, and polydextrose powder, wherein the ingredients are admixed in Hobart mixer (Model N-50) for about 4-5 minutes at about 120 rpm to form a smokeless tobacco composition. The smokeless tobacco composition is passed through a meat grinder on the Hobart mixer to incorporate the liquid ingredients into the dry ingredients. The smokeless tobacco composition is extruded through a grinder apparatus. Upon extrusion, the smokeless tobacco composition is placed in a Hobart mixer to form a powder granulation. The mixture of the smokeless tobacco composition is about 11.1 parts binder material, 31.8 parts tobacco material, 29.2 parts humectant, 1 part emulsifier, 3.5 parts vegetable protein, 14.6 parts polydextrose, 3.6 parts corn syrup, 2.2 parts glycerin, 1.9 parts salt, 0.2 parts sucralose, and 0.8 parts flavorant.

The granulated smokeless tobacco composition is transferred to an injection mold and compressed at about 103,500 kPa for 1 minute. The mold is a stainless steel two-piece block that is filled with the smokeless tobacco composition and then compressed via engagement with a hydraulic press unit (Wabach Hydraulic Press, Model 12-102T, Serial 2201). The smokeless tobacco composition is removed from the injection mold after cooling at ambient temperature for about 60 minutes.

Example 14

A smokeless tobacco composition suitable for use as a smokeless tobacco product for oral use is provided in the following manner.

A vegetable protein (available from Freeman Industries LLC) is combined with water. A humectant (available as HYSTAR 3375 from Corn Products International), an emulsifier (available as DUR-EM 117 from Loders Croklaan), corn syrup, glycerin and the hydrated vegetable protein are admixed to form a liquid blend. The liquid blend is heated to about 54° C. A flavorant is added to the heated liquid blend.

A tobacco material blend of two types of tobacco material having an average particle size of less than about 100 microns is mixed with a binder material (gum arabic), a salt, a sweetener (sucralose) and polydextrose powder (available as LITESSE from Danisco A/S) in a Hobart mixing bowl. The liquid blend is added to the Hobart mixing bowl containing the tobacco material blend, binder material, salt, sweetener, and polydextrose powder, wherein the ingredients are admixed in Hobart mixer (Model N-50) for about 4-5 minutes at about 120 rpm to form a smokeless tobacco composition. The smokeless tobacco composition is passed through a meat grinder on the Hobart mixer to incorporate the liquid ingredients into the dry ingredients. The smokeless tobacco composition is extruded through a grinder apparatus. Upon extrusion, the smokeless tobacco composition is placed in a Hobart mixer to form a powder granulation. The mixture of the smokeless tobacco composition is about 9.9 parts binder material, 28.4 parts tobacco material, 26 parts humectant, 0.9 parts emulsifier, 3.3 parts vegetable protein, 10.6 parts water, 13 parts polydextrose, 3.3 parts corn syrup, 2 parts glycerin, 1.7 parts salt, 0.2 parts sucralose, and 0.7 parts flavorant.

The granulated smokeless tobacco composition is transferred to an injection mold and compressed at about 103,500 kPa for 1 minute. The mold is a stainless steel two-piece block that is filled with the smokeless tobacco composition and then compressed via engagement with a hydraulic press unit (Wabach Hydraulic Press, Model 12-102T, Serial 2201). The smokeless tobacco composition is removed from the injection mold after cooling at ambient temperature for about 60 minutes.

Example 15

A smokeless tobacco composition suitable for use as a smokeless tobacco product for oral use is provided in the following manner.

A humectant (available as HYSTAR 3375 from Corn Products International), an emulsifier (available as DUR-EM 117 from Loders Croklaan), a vegetable protein (available from Freeman Industries LLC), corn syrup, and glycerin are admixed to form a liquid blend. The liquid blend is heated to about 54° C. A flavorant is added to the heated liquid blend.

A tobacco material blend of two types of tobacco material having an average particle size of less than about 100 microns is mixed with a binder material (gum arabic), a salt, a sweetener (sucralose) and polydextrose powder (available as LITESSE from Danisco A/S) in a Hobart mixing bowl. The liquid blend is added to the Hobart mixing bowl containing the tobacco material blend, binder material, salt, sweetener, and polydextrose powder, wherein the ingredients are admixed in Hobart mixer (Model N-50) for about 4-5 minutes at about 120 rpm to form a smokeless tobacco composition. The smokeless tobacco composition is passed through a meat grinder on the Hobart mixer to incorporate the liquid ingredients into the dry ingredients. The smokeless tobacco composition is extruded through a grinder apparatus. Upon extrusion, the smokeless tobacco composition is placed in a Hobart mixer to form a powder granulation. The mixture of the smokeless tobacco composition is about 10.7 parts binder material, 30.7 parts tobacco material, 28.1 parts humectant, 1 part emulsifier, 6.9 parts vegetable protein, 14.1 parts polydextrose, 3.5 parts corn syrup, 2.1 parts glycerin, 1.8 parts salt, 0.2 parts sucralose, and 0.8 parts flavorant.

The granulated smokeless tobacco composition is transferred to an injection mold and compressed at about 103,500 kPa for 1 minute. The mold is a stainless steel two-piece block that is filled with the smokeless tobacco composition and then compressed via engagement with a hydraulic press unit (Wabach Hydraulic Press, Model 12-102T, Serial 2201). The smokeless tobacco composition is removed from the injection mold after cooling at ambient temperature for about 60 minutes.

Example 16

A smokeless tobacco composition suitable for use as a smokeless tobacco product for oral use is provided in the following manner.

A humectant (available as HYSTAR 3375 from Corn Products International), an emulsifier (available as DUR-EM 117 from Loders Croklaan), a vegetable protein (available from Freeman Industries LLC), corn syrup, and glycerin are admixed to form a liquid blend. The liquid blend is heated to about 54° C. A flavorant is added to the heated liquid blend.

A tobacco material blend of two types of tobacco material having an average particle size of less than about 100 microns is mixed with a binder material (gum arabic), a salt, a sweetener (sucralose) and polydextrose powder (available as LITESSE from Danisco A/S) in a Hobart mixing bowl. The liquid blend is added to the Hobart mixing bowl containing the tobacco material blend, binder material, salt, sweetener, and polydextrose powder, wherein the ingredients are admixed in Hobart mixer (Model N-50) for about 4-5 minutes at about 120 rpm to form a smokeless tobacco composition. The smokeless tobacco composition is passed through a meat grinder on the Hobart mixer to incorporate the liquid ingredients into the dry ingredients. The smokeless tobacco composition is extruded through a grinder apparatus. Upon extrusion, the smokeless tobacco composition is placed in a Hobart mixer to form a powder granulation. The mixture of the smokeless tobacco composition is about 11.2 parts binder material, 32.3 parts tobacco material, 24.6 parts humectant, 1.1 parts emulsifier, 7.2 parts vegetable protein, 14.8 parts polydextrose, 3.7 parts corn syrup, 2.2 parts glycerin, 1.9 parts salt, 0.2 parts sucralose, and 0.8 parts flavorant.

The granulated smokeless tobacco composition is transferred to an injection mold and compressed at about 103,500 kPa for 1 minute. The mold is a stainless steel two-piece block that is filled with the smokeless tobacco composition and then compressed via engagement with a hydraulic press unit (Wabach Hydraulic Press, Model 12-102T, Serial 2201). The smokeless tobacco composition is removed from the injection mold after cooling at ambient temperature for about 60 minutes.

Example 17

A smokeless tobacco composition suitable for use as a smokeless tobacco product for oral use is provided in the following manner.

A vegetable protein (available from Freeman Industries LLC) is combined with water. A humectant (available as HYSTAR 3375 from Corn Products International), an emulsifier (available as DUR-EM 117 from Loders Croklaan), corn syrup, glycerin and the hydrated vegetable protein are admixed to form a liquid blend. The liquid blend is heated to about 54° C. A flavorant is added to the heated liquid blend.

A tobacco material blend of two types of tobacco material having an average particle size of less than about 100 microns is mixed with a binder material (gum arabic), a salt, a sweetener (sucralose) and polydextrose powder (available as LITESSE from Danisco A/S) in a Hobart mixing bowl. The liquid blend is added to the Hobart mixing bowl containing the tobacco material blend, binder material, salt, sweetener, and polydextrose powder, wherein the ingredients are admixed in Hobart mixer (Model N-50) for about 4-5 minutes at about 120 rpm to form a smokeless tobacco composition. The smokeless tobacco composition is passed through a meat grinder on the Hobart mixer to incorporate the liquid ingredients into the dry ingredients. The smokeless tobacco composition is extruded through a grinder apparatus. Upon extrusion, the smokeless tobacco composition is placed in a Hobart mixer to form a powder granulation. The mixture of the smokeless tobacco composition is about 9.9 parts binder material, 28.4 parts tobacco material, 26 parts humectant, 0.9 parts emulsifier, 6.5 parts vegetable protein, 21.3 parts water, 13 parts polydextrose, 3.3 parts corn syrup, 2 parts glycerin, 1.7 parts salt, 0.2 parts sucralose, and 0.7 parts flavorant.

The granulated smokeless tobacco composition is transferred to an injection mold and compressed at about 103,500 kPa for 1 minute. The mold is a stainless steel two-piece block that is filled with the smokeless tobacco composition and then compressed via engagement with a hydraulic press unit (Wabach Hydraulic Press, Model 12-102T, Serial 2201). The smokeless tobacco composition is removed from the injection mold after cooling at ambient temperature for about 60 minutes.

Example 18

A smokeless tobacco composition suitable for use as a smokeless tobacco product for oral use is provided in the following manner.

A humectant (available as HYSTAR 3375 from Corn Products International), an emulsifier (available as DUR-EM 117 from Loders Croklaan), a vegetable protein (available from Freeman Industries LLC), corn syrup, and glycerin are admixed to form a liquid blend. The liquid blend is heated to about 54° C. A flavorant is added to the heated liquid blend.

A tobacco material blend of two types of tobacco material having an average particle size of less than about 100 microns is mixed with a binder material (gum arabic), a salt, a sweetener (sucralose) and polydextrose powder (available as LITESSE from Danisco A/S) in a Hobart mixing bowl. The liquid blend is added to the Hobart mixing bowl containing the tobacco material blend, binder material, salt, sweetener, and polydextrose powder, wherein the ingredients are admixed in Hobart mixer (Model N-50) for about 4-5 minutes at about 120 rpm to form a smokeless tobacco composition. The smokeless tobacco composition is passed through a meat grinder on the Hobart mixer to incorporate the liquid ingredients into the dry ingredients. The smokeless tobacco composition is extruded through a grinder apparatus. Upon extrusion, the smokeless tobacco composition is placed in a Hobart mixer to form a powder granulation. The mixture of the smokeless tobacco composition is about 11.2 parts binder material, 32.3 parts tobacco material, 24.6 parts humectant, 1.1 parts emulsifier, 4.6 parts vegetable protein, 14.8 parts polydextrose, 3.7 parts corn syrup, 2.2 parts glycerin, 1.9 parts salt, 0.2 parts sucralose, and 0.8 parts flavorant.

The granulated smokeless tobacco composition is transferred to an injection mold and compressed at about 103,500 kPa for 1 minute. The mold is a stainless steel two-piece block that is filled with the smokeless tobacco composition and then compressed via engagement with a hydraulic press unit (Wabach Hydraulic Press, Model 12-102T, Serial 2201). The smokeless tobacco composition is removed from the injection mold after cooling at ambient temperature for about 60 minutes.

Example 19

A smokeless tobacco composition suitable for use as a smokeless tobacco product for oral use is provided in the following manner.

A gelatin (fish) with a bloom of about 275 is combined with water. A humectant (available as HYSTAR 3375 from Corn Products International), an emulsifier (available as DUR-EM 117 from Loders Croklaan), corn syrup, and glycerin are admixed to form a liquid blend. The liquid blend is heated to about 110° C. The hydrated gelatin and a flavorant are added to the heated liquid blend.

A tobacco material blend of two types of tobacco material having an average particle size of less than about 100 microns is mixed with a binder material (gum arabic), a salt, a sweetener (sucralose) and polydextrose powder (available as LITESSE from Danisco A/S) in a Hobart mixing bowl. The liquid blend is added to the Hobart mixing bowl containing the tobacco material blend, binder material, salt, sweetener, and polydextrose powder, wherein the ingredients are admixed in Hobart mixer (Model N-50) for about 4-5 minutes at about 120 rpm to form a smokeless tobacco composition. The smokeless tobacco composition is passed through a meat grinder on the Hobart mixer to incorporate the liquid ingredients into the dry ingredients. The smokeless tobacco composition is extruded through a grinder apparatus. Upon extrusion, the smokeless tobacco composition is placed in a Hobart mixer to form a powder granulation. The mixture of the smokeless tobacco composition is about 9.8 parts binder material, 28 parts tobacco material, 25.6 parts humectant, 0.9 parts emulsifier, 7.6 parts gelatin, 7.6 parts water, 12.8 parts polydextrose, 3.2 parts corn syrup, 1.9 parts glycerin, 1.6 parts salt, 0.2 parts sucralose, and 0.7 parts flavorant.

The granulated smokeless tobacco composition is transferred to an injection mold and compressed at about 103,500 kPa for 1 minute. The mold is a stainless steel two-piece block that is filled with the smokeless tobacco composition and then compressed via engagement with a hydraulic press unit (Wabach Hydraulic Press, Model 12-102T, Serial 2201). The smokeless tobacco composition is removed from the injection mold after cooling at ambient temperature for about 60 minutes.

Example 20

A smokeless tobacco composition suitable for use as a smokeless tobacco product for oral use is provided in the following manner.

A gelatin (fish) with a bloom of about 275 is combined with water. A humectant (available as HYSTAR 3375 from Corn Products International), an emulsifier (available as DUR-EM 117 from Loders Croklaan), corn syrup, and glycerin are admixed to form a liquid blend. The liquid blend is heated to about 110° C. The hydrated gelatin and a flavorant are added to the heated liquid blend.

A tobacco material blend of two types of tobacco material having an average particle size of less than about 100 microns is mixed with a binder material (gum arabic), a salt, a sweetener (sucralose) and polydextrose powder (available as LITESSE from Danisco A/S) in a Hobart mixing bowl. The liquid blend is added to the Hobart mixing bowl containing the tobacco material blend, binder material, salt, sweetener, and polydextrose powder, wherein the ingredients are admixed in Hobart mixer (Model N-50) for about 4-5 minutes at about 120 rpm to form a smokeless tobacco composition. The smokeless tobacco composition is passed through a meat grinder on the Hobart mixer to incorporate the liquid ingredients into the dry ingredients. The smokeless tobacco composition is extruded through a grinder apparatus. Upon extrusion, the smokeless tobacco composition is placed in a Hobart mixer to form a powder granulation. The mixture of the smokeless tobacco composition is about 10.4 parts binder material, 27.8 parts tobacco material, 27.3 parts humectant, 1 part emulsifier, 4.9 parts gelatin, 4.9 parts water, 13.6 parts polydextrose, 3.4 parts corn syrup, 2 parts glycerin, 1.8 parts salt, 0.2 parts sucralose, and 0.8 parts flavorant.

The granulated smokeless tobacco composition is transferred to an injection mold and compressed at about 103,500 kPa for 1 minute. The mold is a stainless steel two-piece block that is filled with the smokeless tobacco composition and then compressed via engagement with a hydraulic press unit (Wabach Hydraulic Press, Model 12-102T, Serial 2201). The smokeless tobacco composition is removed from the injection mold after cooling at ambient temperature for about 60 minutes.

Example 21

A smokeless tobacco composition suitable for use as a smokeless tobacco product for oral use is provided in the following manner.

A gelatin (fish) with a bloom of about 275 is combined with water. A humectant (available as HYSTAR 3375 from Corn Products International), an emulsifier (available as DUR-EM 117 from Loders Croklaan), corn syrup, and glycerin are admixed to form a liquid blend. The liquid blend is heated to about 143° C. The hydrated gelatin and a flavorant are added to the heated liquid blend.

A tobacco material blend of two types of tobacco material having an average particle size of less than about 100 microns is mixed with a binder material (gum arabic), a salt, a sweetener (sucralose) and polydextrose powder (available as LITESSE from Danisco A/S) in a Hobart mixing bowl. The liquid blend is added to the Hobart mixing bowl containing the tobacco material blend, binder material, salt, sweetener, and polydextrose powder, wherein the ingredients are admixed in Hobart mixer (Model N-50) for about 4-5 minutes at about 120 rpm to form a smokeless tobacco composition. The smokeless tobacco composition is passed through a meat grinder on the Hobart mixer to incorporate the liquid ingredients into the dry ingredients. The smokeless tobacco composition is extruded through a grinder apparatus. Upon extrusion, the smokeless tobacco composition is placed in a Hobart mixer to form a powder granulation. The mixture of the smokeless tobacco composition is about 9.8 parts binder material, 28 parts tobacco material, 27.4 parts humectant, 0.9 parts emulsifier, 7.6 parts gelatin, 7.6 parts water, 12.8 parts polydextrose, 3.2 parts corn syrup, 1.9 parts glycerin, 1.6 parts salt, 0.2 parts sucralose, and 0.7 parts flavorant.

The granulated smokeless tobacco composition is transferred to an injection mold and compressed at about 103,500 kPa for 1 minute. The mold is a stainless steel two-piece block that is filled with the smokeless tobacco composition and then compressed via engagement with a hydraulic press unit (Wabach Hydraulic Press, Model 12-102T, Serial 2201). The smokeless tobacco composition is removed from the injection mold after cooling at ambient temperature for about 60 minutes.

Many modifications and other embodiments of the invention will come to mind to one skilled in the art to which this invention pertains having the benefit of the teachings presented in the foregoing description. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A process for preparing a smokeless tobacco composition pastille configured for insertion into the mouth of a user, comprising:

mixing a tobacco material with a binder and a polysaccharide filler component to form a smokeless tobacco mixture;

extruding the smokeless tobacco mixture into an extruded form;

grinding the extruded form of the smokeless tobacco mixture into a ground form;

injection molding the ground form of the smokeless tobacco mixture; and cooling the smokeless tobacco mixture to form a solidified smokeless tobacco composition pastille.

2. The process of claim 1, wherein the binder comprises a water soluble gum.

3. The process of claim 2, wherein the binder is gum arabic.

4. The process of claim 1, wherein mixing a tobacco material with a binder and a polysaccharide filler component further comprises mixing a tobacco material with a binder, a polysaccharide filler component and an additional filler component to form a smokeless tobacco mixture.

5. The process of claim 4, wherein the additional filler component comprises a sugar alcohol.

6. The process of claim 5, wherein the additional filler component comprises sorbitol.

7. The process of claim 1, wherein the step of injection molding the smokeless tobacco mixture comprises compressing the smokeless tobacco mixture using a compressive force of at least about 75,000 kPa.

8. The process of claim 1, wherein the step of cooling the smokeless tobacco mixture further comprises cooling the smokeless tobacco mixture to a temperature of about 20° C. to about 25° C.

9. The process of claim 1, further comprising the step of adding an additive to the tobacco material prior to the mixing step, the additive being selected from the group consisting of flavorants, emulsifiers, disintegration aids, humectants, and mixtures thereof.

10. The process of claim 1, wherein the step of mixing a tobacco material with a binder and a polysaccharide filler component comprises mixing a tobacco material having a moisture content of less than about 5 percent with a binder and a polysaccharide filler component.

11. The process of claim 1, wherein the step of mixing a tobacco material with a binder and a polysaccharide filler component comprises mixing a tobacco material having an average particle size of less than about 50 microns with a binder and a polysaccharide filler component.

12. The process of claim 1, wherein said mixing step comprises forming a dry blend comprising a mixture of the tobacco material, the binder, and the polysaccharide filler component, and combining the dry blend with a liquid component to form the smokeless tobacco mixture.

13. The process of claim 12, wherein the dry blend further comprises a salt, a sweetener, or a combination thereof.

14. The process of claim 12, wherein the liquid component comprises a humectant, an emulsifier, a gelling agent, a syrup, or a combination thereof.

15. A process for preparing a smokeless tobacco composition pastille configured for insertion into the mouth of a user, comprising:

mixing a tobacco material with a binder and a polysaccharide filler component to form a smokeless tobacco mixture;

extruding the smokeless tobacco mixture into an extruded form;

grinding the extruded form of the smokeless tobacco mixture into a ground form;

injection molding the ground form of the smokeless tobacco mixture; and cooling the smokeless tobacco mixture to form a solidified smokeless tobacco composition pastille, wherein the polysaccharide filler component comprises polydextrose.

16. The process of claim 15, wherein the binder comprises a water soluble gum.

17. The process of claim 16, wherein the binder is gum arabic.

18. The process of claim 15, wherein mixing a tobacco material with a binder and a polysaccharide filler component further comprises mixing a tobacco material with a binder, a polysaccharide filler component and an additional filler component to form a smokeless tobacco mixture.

19. The process of claim 18, wherein the additional filler component comprises a sugar alcohol.

20. The process of claim 18, wherein the additional filler component comprises sorbitol.

21. The process of claim 15, wherein the step of injection molding the smokeless tobacco mixture comprises compressing the smokeless tobacco mixture using a compressive force of at least about 75,000 kPa.

22. The process of claim 15, wherein the step of cooling the smokeless tobacco mixture further comprises cooling the smokeless tobacco mixture to a temperature of about 20° C. to about 25° C.

23. The process of claim 15, further comprising the step of adding an additive to the tobacco material prior to the mixing step, the additive being selected from the group consisting of flavorants, emulsifiers, disintegration aids, humectants, and mixtures thereof.

24. The process of claim 15, wherein the step of mixing a tobacco material with a binder and a polysaccharide filler component comprises mixing a tobacco material having a moisture content of less than about 5 percent with a binder and a polysaccharide filler component.

25. The process of claim 15, wherein the step of mixing a tobacco material with a binder and a polysaccharide filler component comprises mixing a tobacco material having an average particle size of less than about 50 microns with a binder and a polysaccharide filler component.

26. The process of claim 15, wherein said mixing step comprises forming a dry blend comprising a mixture of the tobacco material, the binder, and the polysaccharide filler component, and combining the dry blend with a liquid component to form the smokeless tobacco mixture.

27. The process of claim 26, wherein the dry blend further comprises a salt, a sweetener, or a combination thereof.

28. The process of claim 26, wherein the liquid component comprises a humectant, an emulsifier, a gelling agent, a syrup, or a combination thereof.

* * * * *